US006657514B1

(12) United States Patent
Tokudera et al.

(10) Patent No.: US 6,657,514 B1
(45) **Date of Patent: *Dec. 2, 2003**

(54) DIELECTRIC TRANSMISSION LINE ATTENUATOR, DIELECTRIC TRANSMISSION LINE TERMINATOR, AND WIRELESS COMMUNICATION DEVICE

(75) Inventors: Hiromu Tokudera, Nagaokakyo (JP); Kei Matsutani, Nagaokakyo (JP); Atsushi Saito, Muko (JP)

(73) Assignee: Murata Manufacturing Co. Ltd

( * ) Notice: Subject to any disclaimer, the term of this patent is extended or adjusted under 35 U.S.C. 154(b) by 41 days.

This patent is subject to a terminal disclaimer.

(21) Appl. No.: 09/595,604

(22) Filed: Jun. 16, 2000

(30) Foreign Application Priority Data

Jun. 18, 1999 (JP) ..... 11-172234

(51) Int. Cl.[7] ..... H01P 1/22; H01P 1/26; H01P 3/16

(52) U.S. Cl. ..... 333/81 B; 333/248; 333/22 R

(58) Field of Search ..... 333/248, 251, 333/81 B, 24.2, 22 R

(56) References Cited

U.S. PATENT DOCUMENTS 5,770,989 A * 6/1998 Ishikawa et al. ..... 333/248
6,094,106 A * 7/2000 Kishino et al. ..... 333/22 R
6,441,698 B1 * 8/2002 Matsutani et al. ..... 333/81 B

FOREIGN PATENT DOCUMENTS

JP 6-252604 9/1994

OTHER PUBLICATIONS

Japanese Examination Reported issued Sep. 17, 2002 (w/ relevant English translation).

* cited by examiner

*Primary Examiner*—Robert Pascal
*Assistant Examiner*—Stephen E. Jones
(74) *Attorney, Agent, or Firm*—Dickstein, Shapiro, Morin & Oshinsky, LLP.

(57) ABSTRACT

A dielectric transmission line attenuator or terminator, which is used with a dielectric transmission line provided with two conductive plates substantially parallel to each other and a dielectric strip held between the two conductive plates. A resistor film pattern is provided along a surface defined where upper and lower parts of the dielectric strip are divided, and substantially parallel to the two conductive plates. The resistor film pattern and the two conductive plates form a transmission line, and the dielectric transmission line and the transmission line are coupled.

20 Claims, 11 Drawing Sheets

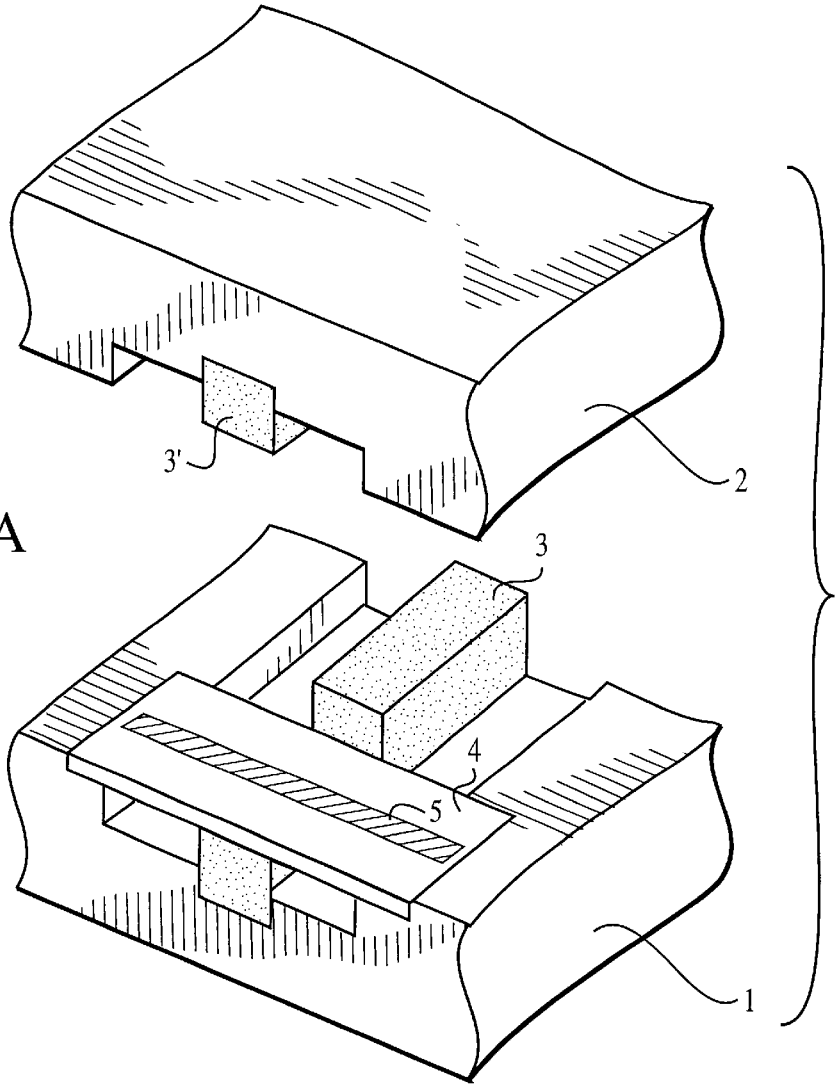
FIG. 6A
FIG. 6B
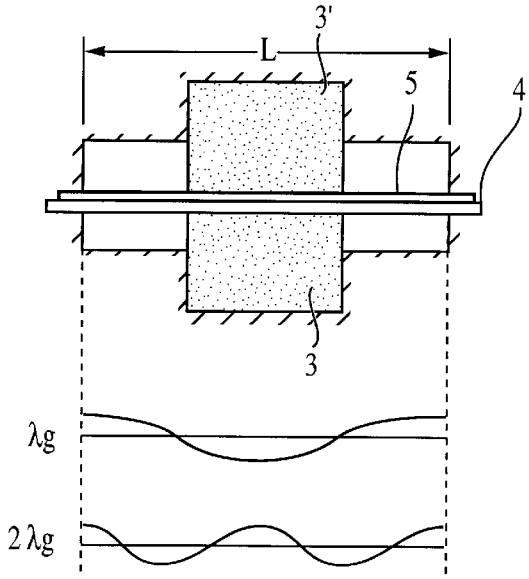

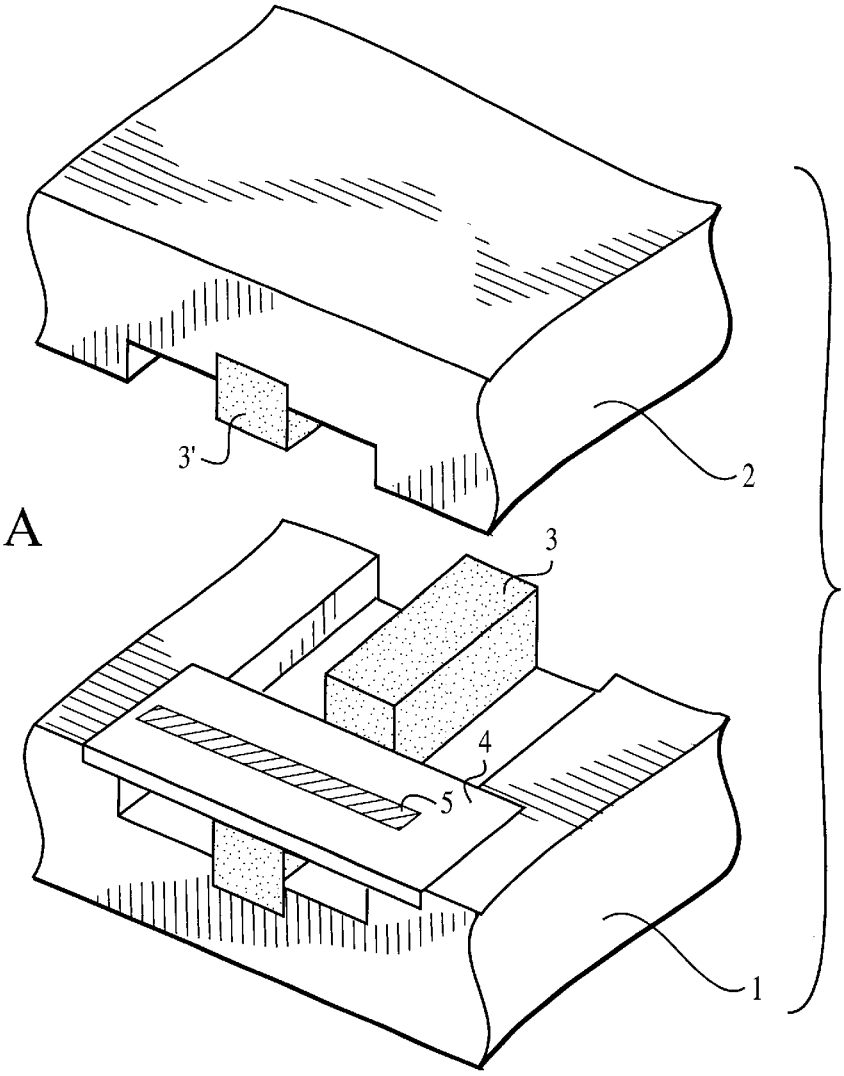
FIG. 7A
FIG. 7B
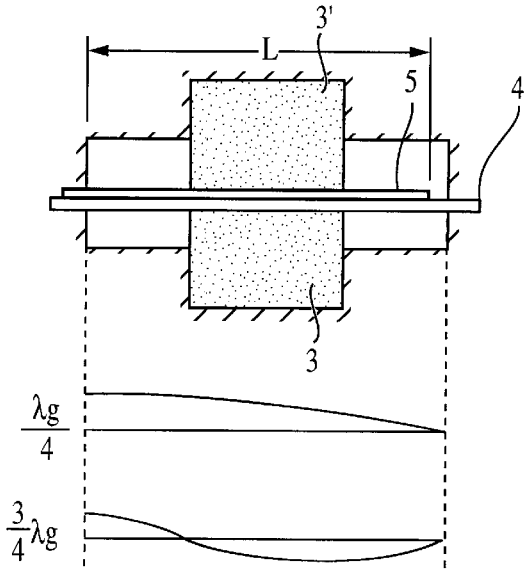

DIELECTRIC TRANSMISSION LINE ATTENUATOR, DIELECTRIC TRANSMISSION LINE TERMINATOR, AND WIRELESS COMMUNICATION DEVICE

BACKGROUND OF THE INVENTION

1. Field of the Invention

The present invention relates to a dielectric transmission line attenuator and a dielectric transmission line terminator, which are used in a millimeter-wave band or the like, and relates to a wireless communication device using the same.

2. Description of the Related Art

A millimeter-wave integrated circuit using a nonradiative dielectric guide (NRD-guide) was shown in IEICE Trans. (C-I), Vol.J73-C-I, No.3, pp.87–94 (March 1990).

In the NRD guide, a dielectric strip is disposed between two parallel conductive plates. The dielectric strip serves as a propagation region for electromagnetic waves, and spaces defined between the two parallel conductive plates at both sides of the dielectric strip serve as cutoff regions for the electromagnetic waves. As a terminator for such an NRD-guide, a resistor film for absorbing the electromagnetic waves is provided at the dielectric strip.

FIG. 12 shows the construction of the dielectric terminator (the two conductive plates which hold the dielectric strip are not shown in FIG. 12). The dielectric strip is divided into upper and lower dielectric strip parts. These two dielectric strip parts hold a resistor sheet and a dielectric sheet therebetween. As shown in FIG. 12, parts of the resistor sheet and the dielectric sheet are tapered. In these parts, impedance transformation of the NRD guide is performed. Furthermore, the energy of electromagnetic waves traveling in an $LSM_{01}$ mode via the NRD-guide is absorbed in the resistor sheet. Accordingly, when the electromagnetic waves travel from the direction indicated by arrow A in FIG. 12, they are terminated at the terminator and are hardly reflected in the opposite direction.

Since impedance transformation is performed at the tapered resistor sheet in the conventional dielectric waveguide terminator shown in FIG. 12, the length of the tapered resistor sheet is required to be long in order to obtain sufficiently low reflection characteristics. Therefore, the overall length of the terminator becomes long as well. Such a dielectric waveguide terminator may be used, for example, at a predetermined port of a circulator in order to form an isolator, or at a predetermined port of a coupler in order to form a directional coupler. However, since the overall length of the terminator becomes long, a dielectric transmission line module using the isolator or the directional coupler inevitably becomes large. For miniaturization, it is effective to form a bend in the NRD guide so that, for example, even if the terminator is long, it can be located in a predetermined position. However, since mode transformation between LSM modes and LSE modes occurs at the bend, losses increase.

A dielectric transmission line attenuator can be constructed by providing the resistor film in the dielectric strip in the middle of the NRD guide. However, in order to sufficiently prevent the electromagnetic waves from being reflected at the resistor film, in the same manner as in the above dielectric transmission line terminator, the resistor film pattern must be formed to have a long, tapered shape. Accordingly, the dielectric transmission line attenuator encounters the same problem as the above dielectric transmission line terminator.

SUMMARY OF THE INVENTION

Accordingly, it is an object of the present invention to provide a dielectric transmission line attenuator and a dielectric transmission line terminator, in which overall miniaturization is achieved by shortening the length of the dielectric transmission line in the direction of propagation of electromagnetic waves via the dielectric transmission line, and to provide a wireless communication device using them.

To this end, according to a first aspect of the present invention, there is provided a dielectric transmission line attenuator used with a dielectric transmission line provided with two conductive plates substantially parallel to each other and a dielectric strip held between the two conductive plates. The dielectric transmission line attenuator includes a resistor film pattern provided along a surface where two parts of the dielectric strip are divided and substantially parallel to the two conductive plates. In the dielectric transmission line attenuator, the resistor film pattern and the two conductive plates form a transmission line, and the dielectric transmission line and the transmission line are coupled.

In the dielectric transmission line attenuator, the transmission line may be a TEM mode resonator having both ends open, having one end open and the other end short-circuited, or having both ends short-circuited. This construction enables attenuation characteristics of the transmission line to be increased in proximity to the resonant frequency of the transmission line. A sufficient amount of the attenuation can be obtained regardless of the small size of the attenuator.

In the dielectric transmission line attenuator, alternatively, a plurality of resistor film patterns are provided, and the distance between two neighboring coupling positions between each of the resistor film patterns and the dielectric strip is an odd multiple of a quarter wavelength. Because of this construction, resonators using a plurality of transmission lines function as band elimination filters, thus ensuring a considerable amount of attenuation over a predetermined bandwidth.

In the dielectric transmission line attenuator, the dielectric constant of a substrate having the resistor film pattern formed thereon may be greater than the dielectric constant of the dielectric strip. Accordingly, by the wavelength reduction effect in the substrate, the length of the transmission line can be decreased. Therefore, the attenuator can be miniaturized.

According to a second aspect of the present invention, a dielectric transmission line terminator includes a dielectric transmission line attenuator according to the first aspect of the present invention provided in proximity to one end of the dielectric strip.

According to a third aspect of the present invention, a wireless communication device includes one of a dielectric transmission line attenuator according to the first aspect of the present invention and a dielectric transmission line terminator according to the second aspect of the present invention. Because of this construction, a wireless communication device, such as a millimeter-wave radar module, using a dielectric transmission line as a transmission line can be easily miniaturized.

Other features and advantages of the present invention will become apparent from the following description of the invention which refers to the accompanying drawings.

BRIEF DESCRIPTION OF THE DRAWINGS

FIG. 6A is an exploded perspective view of a dielectric transmission line terminator according to a second embodiment of the present invention, and FIG. 6B is a cross sectional view of the terminator in FIG. 6A;

FIG. 7A is an exploded perspective view of a dielectric transmission line terminator according to a third embodiment of the present invention, and FIG. 7B is a cross sectional view of the terminator in FIG. 7A;

DESCRIPTION OF EMBODIMENTS OF THE INVENTION

A dielectric transmission line terminator according to a first embodiment of the present invention is described with reference to FIGS. 1 to 5.

Figure 14:
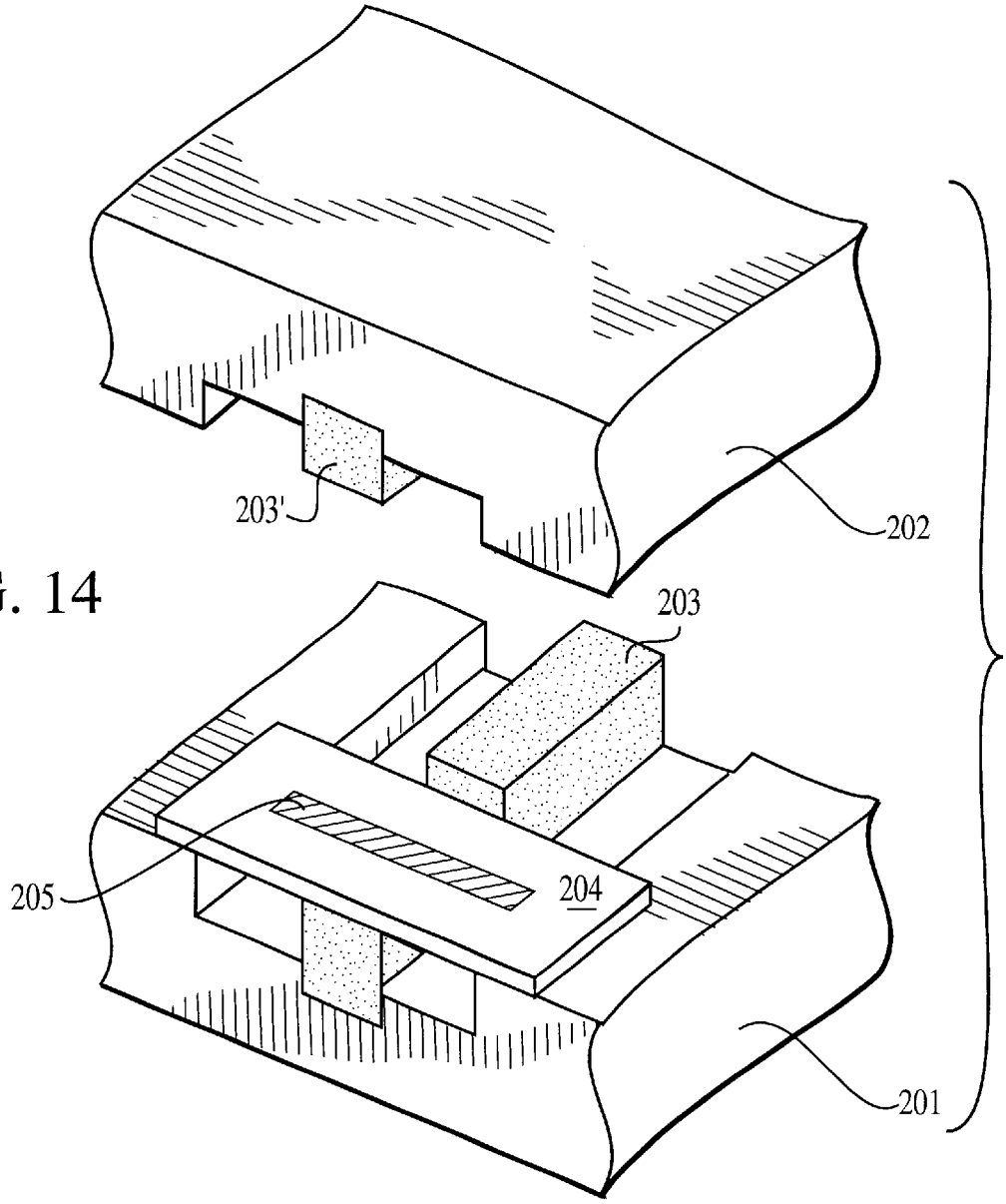
FIG. 14 is an exploded perspective view showing a Type I dielectric transmission line terminator.

In this disclosure, the word "terminator" refers to a device in which a substrate with a resistive pattern is disposed near the end of a waveguide. In a so-called "Type I" terminator, the end of the waveguide may be opened to the air, as seen in the perspective view of FIG. 14.

As shown therein, the substrate 204 with the resistive pattern 205 is disposed near the end 203, 203' of the dielectric strip line which is open to the air.

Figure 13:
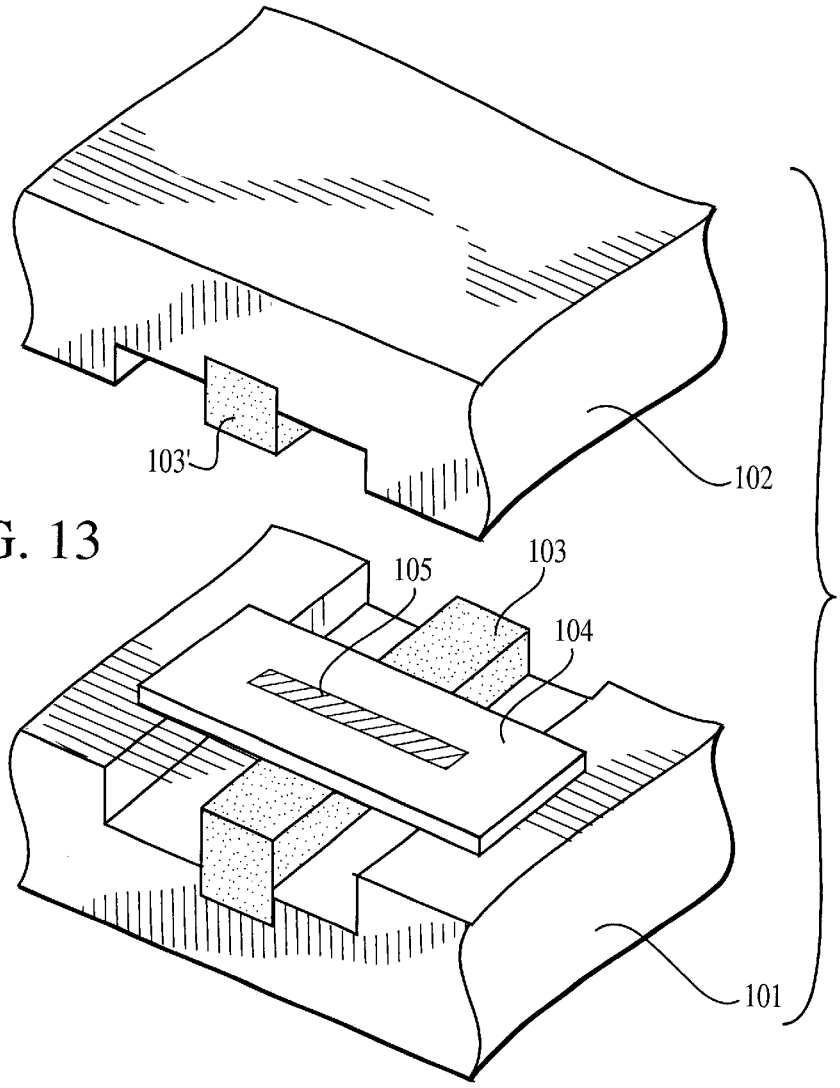
FIG. 13 is an exploded perspective view showing a dielectric transmission line attenuator.

On the other hand, the word "attenuator" refers to a device in which a substrate with a resistive pattern is disposed substantially between the ends, not near an end, of a dielectric waveguide. See for example the perspective view of FIG. 13, wherein the substrate 104 with resistive pattern 105 is spaced away from both ends of the dielectric strip 103, 103'.

In the present disclosure, the terminators are so-called "Type II" terminators, wherein conductive plates contact the ends of the dielectric strips. For example, in the terminator of FIGS. 1–5, and as best seen in FIG. 3B, the conductive plates 1, 2 contact the ends of the dielectric strips 3, 3'. (Other than in FIGS. 1 and 3B, the contact between the conductive plates and the ends of the dielectric strips is not shown.) Thus, in a Type II terminator, as disclosed herein, the ends of the dielectric strips are not open to the air.

Figure 1:
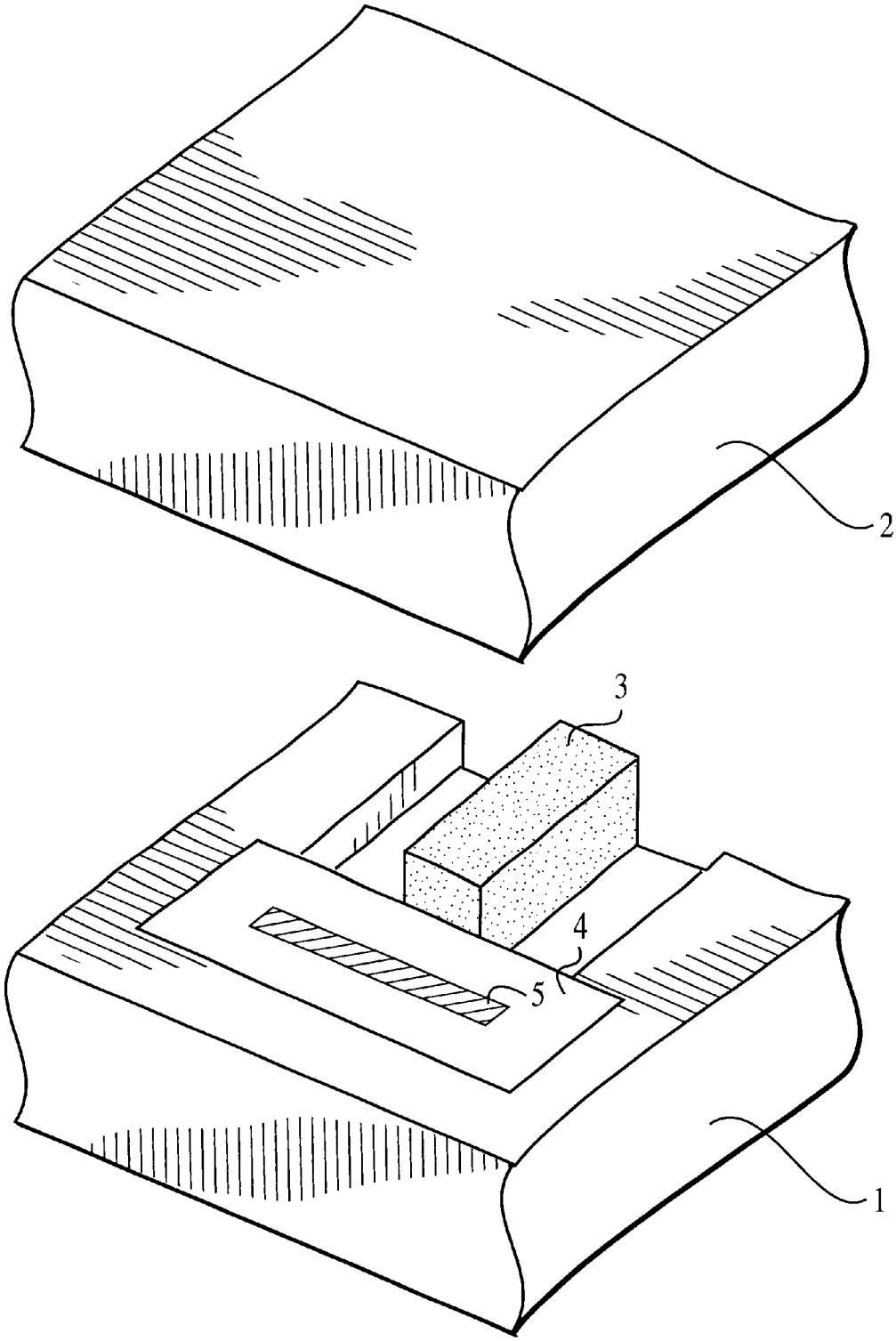
FIG. 1 is an exploded perspective view of a dielectric transmission line terminator according to a first embodiment of the present invention.

FIG. 1 shows an exploded perspective view of main components of the dielectric transmission line terminator. The dielectric transmission line terminator includes conductive plates 1 and 2, a dielectric strip 3 held between the conductive plates 1 and 2, a substrate 4 held between the conductive plates 1 and 2, and a resistor film pattern 5 formed on the surface of the substrate 4.

Figure 2A:
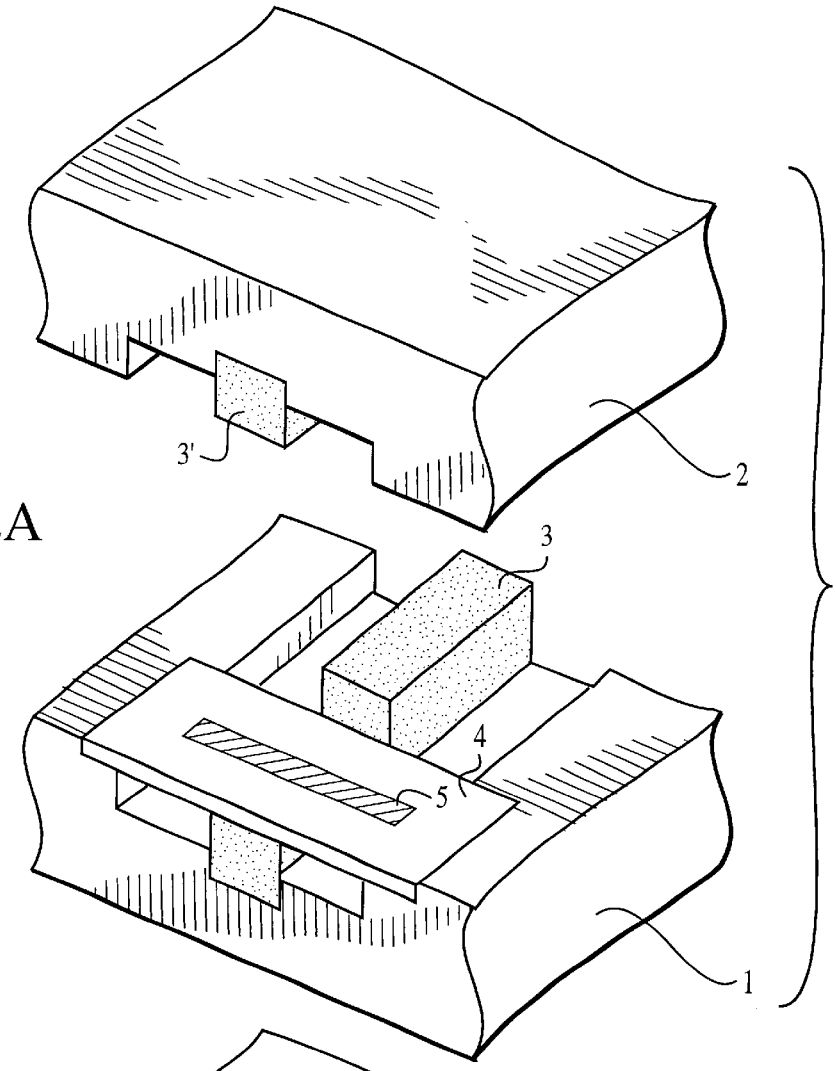
FIG. 2A is an exploded perspective view of the terminator in FIG. 1.
Figure 2B:
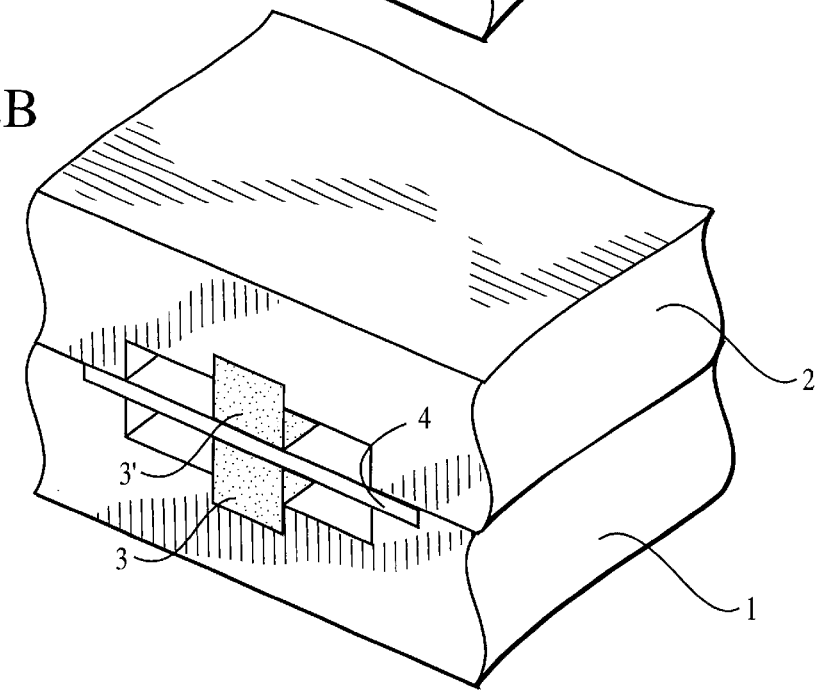
FIG. 2B is a perspective view showing the terminator in an assembled state.

FIG. 2A shows an exploded perspective view of the terminator in FIG. 1 which is cut away along one end face of the substrate 4, and FIG. 2B shows a perspective view of the terminator in an assembled state. The conductive plates 1 and 2 each have grooves having a predetermined depth so that dielectric strips 3 and 3' are fitted in the corresponding grooves. The dielectric strip 3 has a step at one end thereof so that the substrate 4 is held between the dielectric strip 3' and the step of the dielectric strip 3.

In FIGS. 2A and 2B, polytetrafluoroethylene (PTFE) is used for the dielectric strip 3, a PET base material having a thickness of approximately 0.1 to 0.3 mm is used for the substrate 4, and Ni—Cr or ITO having several hundred ohms of sheet resistivity is used as the resistor film pattern 5. When a dielectric material of a high relative dielectric constant, such as polyimide, is used as a base material of the substrate 4, the length of the transmission line in the resistor film pattern 5 can be shortened due to the wavelength reduction effect which is obtained in accordance with the dielectric constant.

Figure 3A:
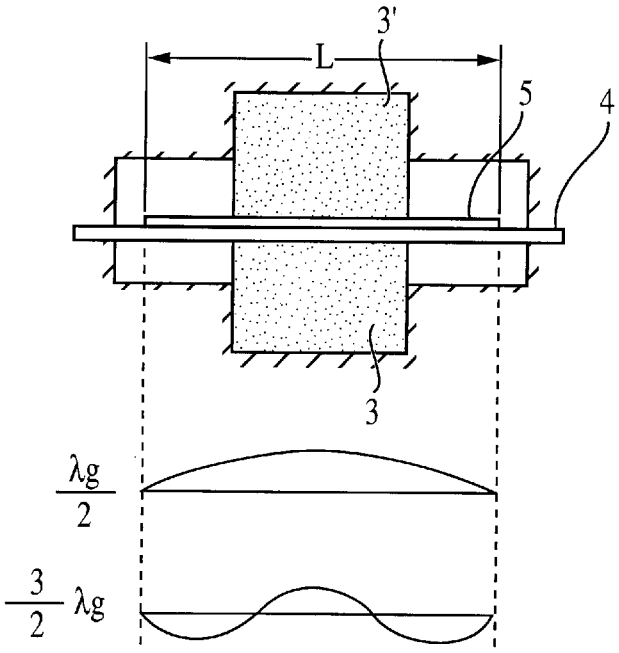
FIGS. 3A and 3B are cross sectional views of the terminator in FIG. 1.
Figure 3B:
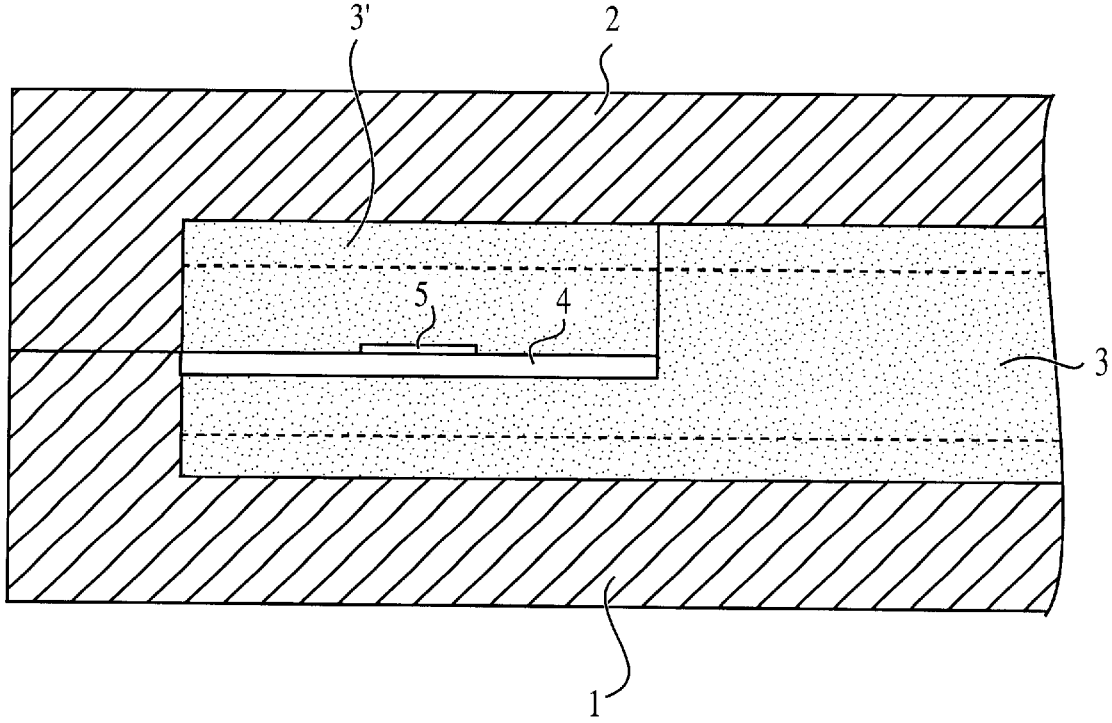

FIG. 3A shows a cross-sectional view taken along a plane which passes through the longitudinal direction of the resistor film pattern 5 shown in FIGS. 1 and 2A and which is perpendicular to the substrate 4. Waveforms in this figure are examples of current density distributions in the resistor film pattern 5. FIG. 3B shows a cross-sectional view taken along a plane which passes through the longitudinal direction of the dielectric strip 3 and is perpendicular to the substrate 4. As shown in FIGS. 3A and 3B, the resistor film pattern 5 is disposed at one end of the dielectric strips 3 and 3', thereby forming a terminator. The resistor film pattern 5 extends perpendicular to the longitudinal direction of the dielectric strip and parallel to the conductive plates 1 and 2. Because of this construction, the resistor film pattern 5 forms a TEM resonator in the form of a suspended line in spaces defined between the conductive plates 1 and 2.

Figure 4:
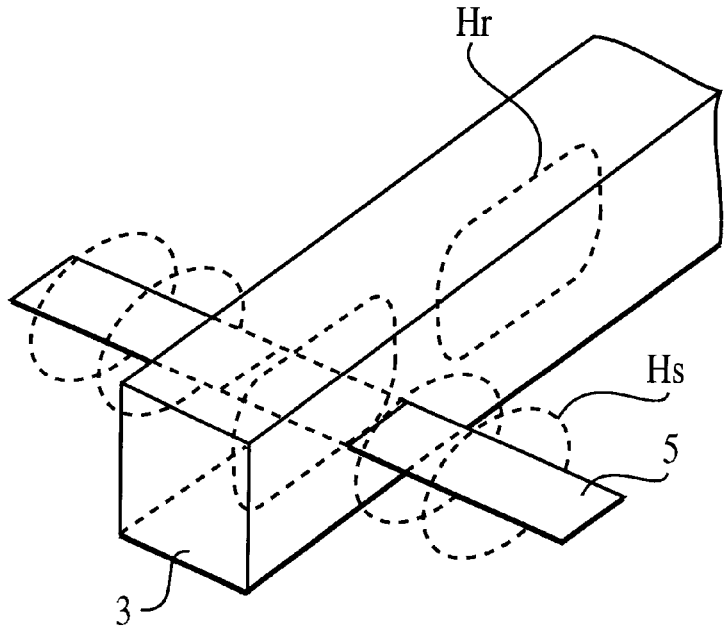
FIG. 4 is an illustration of coupling between the transmission modes of dielectric transmission lines at the dielectric transmission line terminator.

FIG. 4 illustrates coupling between the transmission mode of the electromagnetic waves in the dielectric transmission line terminator and that of the TEM resonator. $H_r$ represents a magnetic field propagating in the dielectric strip 3 in the $LSM_{01}$ mode which faces a plane perpendicular to the upper and lower conductive plates 1 and 2 and parallel to the longitudinal direction of the dielectric strip 4. $H_s$ represents a magnetic field generated in a TEM mode in the resistor film pattern 5. Thus, the $LSM_{01}$ mode and the TEM mode are magnetically coupled.

The ends of the TEM mode resonator are open. In this example, the TEM mode resonator is a half-wavelength resonator. As shown with the waveform corresponding to the wavelength $\lambda_g/2$ in FIG. 3A, nodes of the current density distribution are obtained at the ends of the resonator, and an antinode thereof is obtained at the central part of the resonator. Therefore, the dielectric transmission line in the $LSM_{01}$ mode and the resonator in the TEM mode are magnetically coupled by providing the central part of the resonator in proximity to the dielectric strip, as shown in FIGS. 2A, 2B, 3 and 4.

In the suspended line formed by the resistor film pattern 5, the energy of the electromagnetic waves is consumed due to power loss occurring when high frequency current flows along the longitudinal direction of the suspended line. Because of this, the electromagnetic waves propagating through the dielectric transmission line are attenuated at the resonator by means of the suspended line. Furthermore, since the suspended line comprising the resistor film pattern 5 functions as a half-wavelength resonator having the ends thereof open, the total amount of transformation of the electromagnetic waves from the $LSM_{01}$ mode to the TEM mode at the resonant frequency of the resonator is maximized, whereby the total amount of attenuation is maximized as well.

Figure 5:
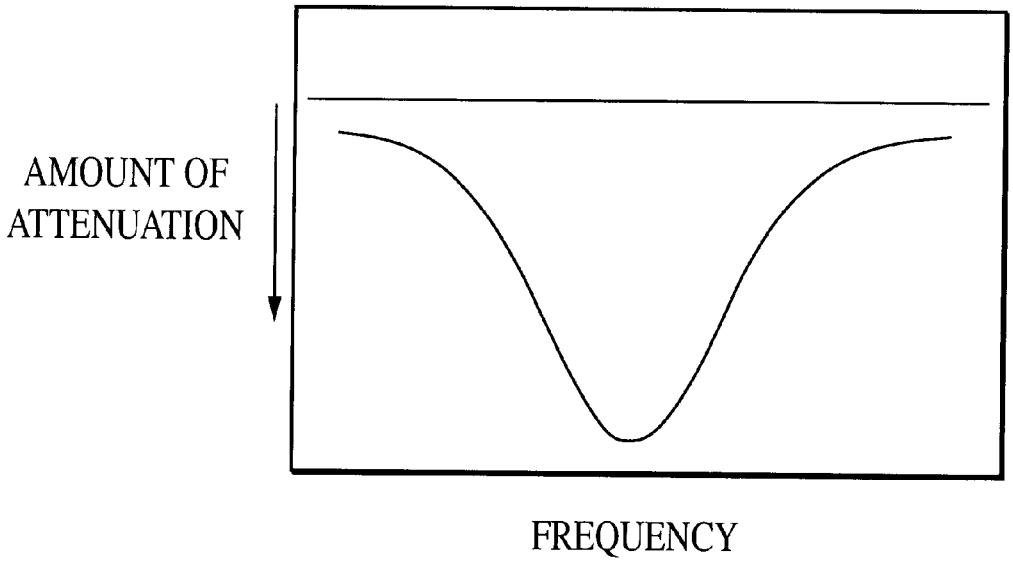
FIG. 5 is a graph showing attenuation-frequency characteristics.

FIG. 5 shows attenuation-frequency characteristics of the electromagnetic waves propagating through the dielectric transmission line. In this context, the amount of the attenuation is the amount by which the electromagnetic waves are attenuated due to the propagating thereof through the resistor film pattern 5 which is provided as the suspended line. There is no particular need to broaden the resistor film pattern 5 in the longitudinal direction of the dielectric strip 3. Therefore, impedance mismatching of the dielectric transmission line does not increase. Accordingly, the reflection of the electromagnetic waves at the resistor film pattern 5 can be suppressed to a low level. Therefore, unlike a conventional dielectric transmission line terminator in which a tapered resistor film pattern extends in the longitudinal direction of a dielectric strip, in the dielectric transmission line terminator according to the present embodiment, a long impedance transformation unit is not required, which enables overall miniaturization to be obtained.

The resonator with the ends of the resistor film pattern 5 open is not limited to being a half-wavelength resonator. As shown by the waveform corresponding to the wavelength $3/2\lambda_g$ in FIG. 3A, the resonator may be constructed so that the resonant wavelength is an integral multiple of a half-wavelength. In this case, the resonator is constructed so that the dielectric transmission line is magnetically coupled to a part of the resonator having high current density distribution (magnetic field intensity).

A dielectric transmission line terminator according to a second embodiment of the present invention is described with reference to FIGS. 6A and 6B.

FIG. 6A is a partly exploded perspective view of the terminator which is shown so as to correspond to the first embodiment shown in FIG. 2A. FIG. 6B is a cross sectional view of the terminator which is shown so as to correspond to the first embodiment shown in FIG. 3A. Unlike the terminator according to the first embodiment, in this terminator there are electrical connections between the conductive plates 1 and 2 and each of the ends of the resistor film pattern 5. That is, the resistor film pattern 5 is longer than a width L, which includes the width of the dielectric strip 3 and the widths of the spaces on both sides thereof. Otherwise, the construction of the terminator is identical to that according the first embodiment. Because of this construction, the resistor film pattern 5, the substrate 4, and the conductive plates 1 and 2 form a suspended line, thus forming a TEM resonator having ends thereof short-circuited. For example, the terminator may be a full-wavelength resonator. As shown by the waveform corresponding to the wavelength $\lambda_g$ in FIG. 6B, antinodes of the current density distribution are obtained at the ends and the central part of the resonator. Therefore, the dielectric transmission line in the $LSM_{01}$ mode and the resonator in the TEM mode are magnetically coupled by providing the dielectric strip 3 in proximity to the central part of the resonator.

The resonator having the ends of the resistor film pattern 5 short-circuited is not limited to being a one-wavelength resonator. As shown by the waveform corresponding to the wavelength $2\lambda_g$ in FIG. 6B, the resonator may be constructed so that the resonant wavelength is an integral multiple of one wavelength.

A dielectric transmission line terminator according to a third embodiment is described with reference to FIGS. 7A and 7B.

FIG. 7A is a partly exploded perspective view of the terminator which is shown so as to correspond to the first embodiment shown in FIG. 2A. FIG. 7B is a cross sectional view of the terminator which is shown so as to correspond to the first embodiment shown in FIG. 3A. Unlike the terminators according to the first and second embodiments, in this terminator there is an electrical connection (short-circuit) with the conductive plates 1 and 2 at one end of the resistor film pattern 5 and no connection at the other end of thereof. Otherwise, the construction of the terminator is identical to that according to the first embodiment. Because of this construction, the resistor film pattern 5, the substrate 4, and the conductive plates 1 and 2 form a suspended line, thus forming a quarter-wavelength TEM resonator. In such a quarter-wavelength resonator, as shown by the waveform corresponding to the wavelength $\lambda_g/4$ in FIG. 7B, a node and an antinode of the current density distribution are obtained at the open end and the short-circuited end of the resonator, respectively. Therefore, the LSM mode in the dielectric transmission line and the TEM mode in the resonator are magnetically or electrically coupled by providing the dielectric strip in proximity to a predetermined position of the resonator. Accordingly, the construction of the quarter-wavelength resonator enables the resistor film pattern 5 as well as the substrate 4 to be further miniaturized. The miniaturization of the overall dielectric transmission line terminator can be achieved.

The resonator having one end of the resistor film pattern 5 short-circuited and the other end thereof open is not necessarily a quarter-wavelength resonator. As shown by the waveform corresponding to the wavelength $3/4\lambda_g$ in FIG. 7B, the resonator may be constructed so that the resonant wavelength is an odd multiple of a quarter wavelength.

Other resistor film patterns 5 are described with reference to FIGS. 8A to 8D.

Figure 8A:
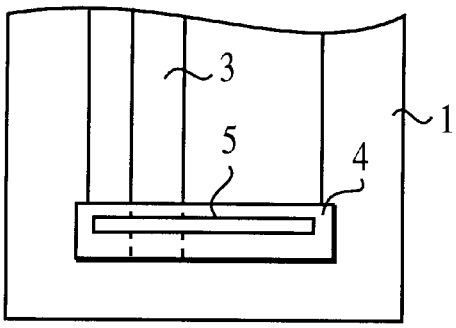
FIGS. 8A to 8D are plan views showing dielectric transmission line terminators having other resistor film patterns with the upper conductive plate and the upper dielectric strip taken away.
Figure 8B:
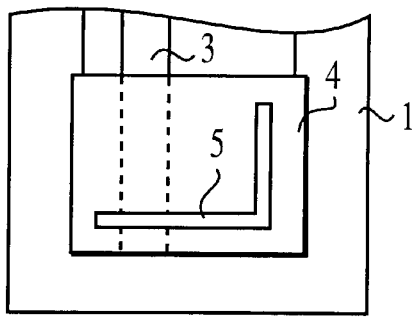

FIGS. 8A to 8D show plan views of dielectric transmission line terminators having the upper conductive plate 2 and the upper dielectric strip 3' taken away. In FIG. 8A, the resistor film pattern 5 is provided on the substrate 4 so as to be asymmetric with respect to the central axis of the dielectric strip 3. Even with such a resistor film pattern 5, the dielectric transmission line in the $LSM_{01}$ mode and the resonator in the TEM mode are magnetically coupled. In FIG. 8B, the resistor film pattern 5 is bent at a predetermined position. Therefore, the length of the dielectric strip 3 can be decreased in the width direction thereof. Even with such a shape of the resistor film pattern 5, the resonator can resonate in accordance with the overall length of the resistor film pattern 5.

Figure 8C:
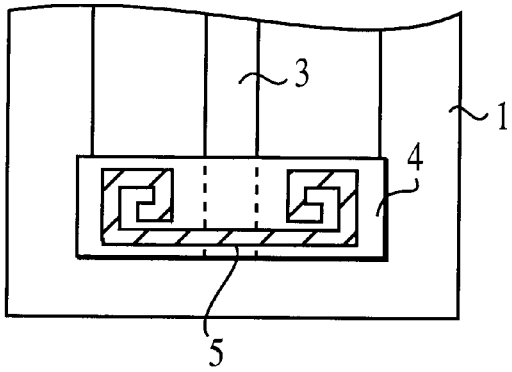
Figure 8D:
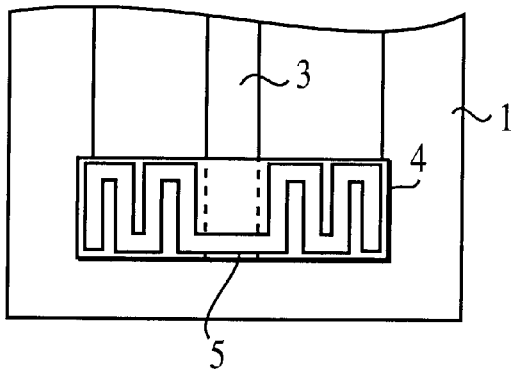

The resistor film pattern 5 has a spiral shape in FIG. 8C and has a meandering shape in FIG. 8D. Using these patterns, the area occupied by the resistor film pattern 5 on the substrate 4 can be reduced, thus enabling the overall dielectric transmission line terminator to be miniaturized.

In each of the examples shown in FIGS. 8A to 8D, the resistor film pattern 5 may have both ends open, may have both ends short-circuited, or may have one end open and the other end short-circuited. The shape of the resistor film pattern 5 and the construction of each end thereof may be appropriately designed in accordance with the size of the space having the substrate 4 incorporated therein and the arrangement relationship among the components of the terminator.

A dielectric transmission line terminator according to a fourth embodiment of the present invention is described with reference to FIGS. 9A and 9B.

Figure 9A:
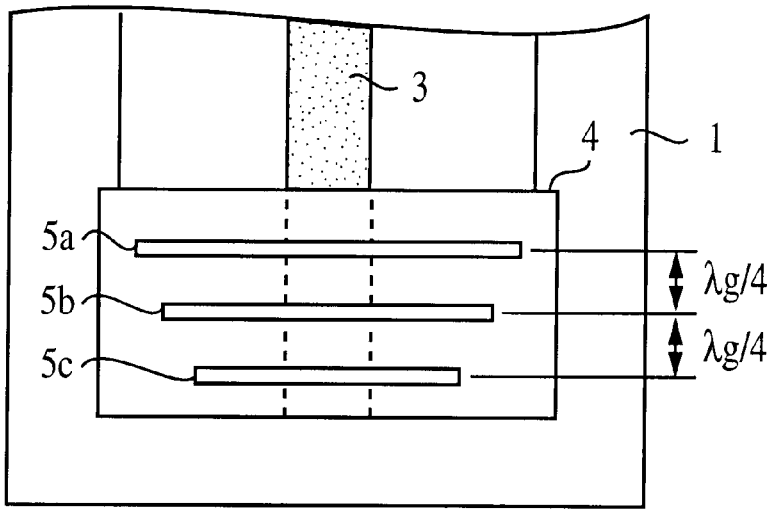
FIG. 9A is a plan view showing a dielectric transmission line terminator according to a fourth embodiment of the present invention.

FIG. 9A shows a plan view of main components of the dielectric transmission line terminator having the upper conductive plate 2 and the upper dielectric strip 3' taken away. Three resistor film patterns 5*a*, 5*b*, and 5*c* are formed on the substrate 4. These resistor film patterns 5*a*, 5*b*, and 5*c* individually form suspended line resonators having ends thereof open using the substrate 4 and the upper and lower conductive plates 1 and 2. These three resonators couple respectively with three parts of the dielectric transmission line, and the distance between each two neighboring coupling parts, which means the distance between each two neighboring resistor film patterns, is $\lambda_g/4$.

Because of this construction, a three-stage resonator is coupled with the dielectric transmission line, forming a band elimination filter. However, unlike conventional band elimination filters, since each resonator is made using a resistor film pattern, resonant energy is consumed in each resonator. Accordingly, since reflection loss is high due to a low Q factor, few of the electromagnetic waves are reflected.

Figure 9B:
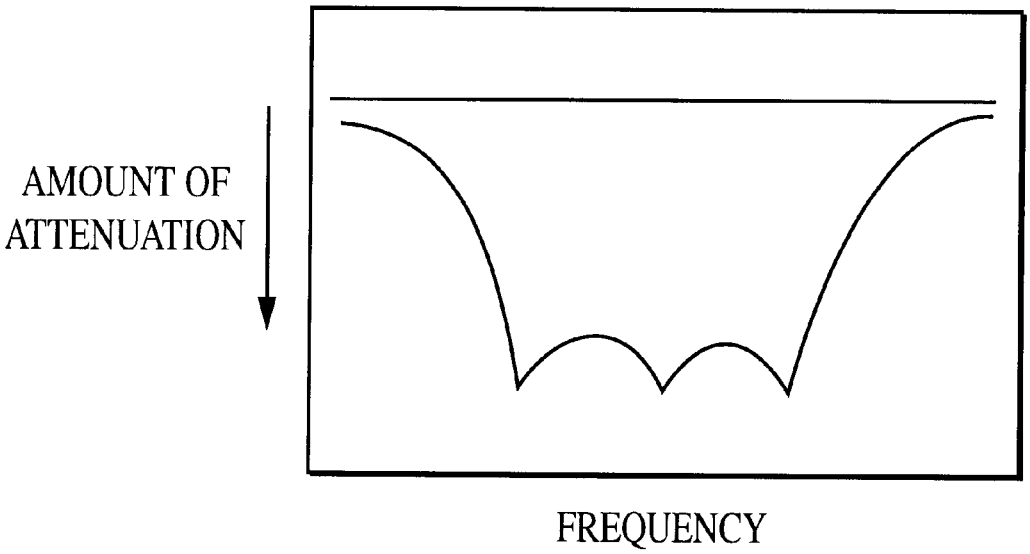
FIG. 9B is a graph showing attenuation-frequency characteristics.

FIG. 9B shows attenuation-frequency characteristics of the dielectric transmission line terminator. Three attenuation poles correspond to the resonant frequencies of the three resonators in FIG. 8, respectively. Thus, a considerable amount of the attenuation can be achieved over a predetermined bandwidth.

A dielectric transmission line attenuator according to a fifth embodiment is described with reference to FIGS. 10A and 10B.

Figure 10A:
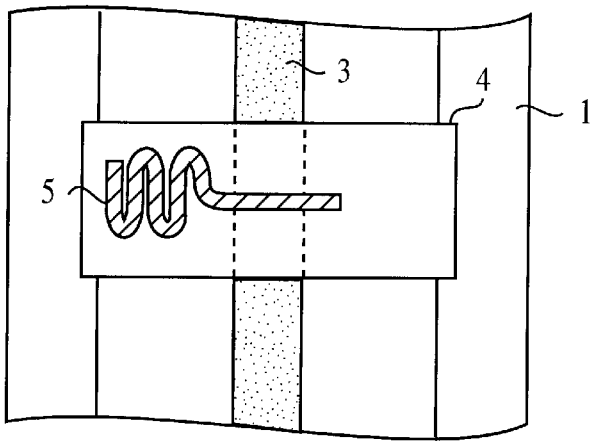
FIG. 10A is a plan view showing main components of a dielectric transmission line attenuator according to a fifth embodiment of the present invention.

FIG. 10A shows a plan view of the dielectric transmission line attenuator having the upper conductive plate 2 and the upper dielectric strip 3' taken away. In this embodiment, the resistor film pattern 5, whose overall length is sufficiently long, is formed on the substrate 4 provided in a predetermined position of the dielectric transmission line. Electromagnetic waves are allowed to travel in the TEM mode in the suspended line formed by of this resistor film pattern 5 by coupling the suspended line with the dielectric transmission line in the $LSM_{01}$ mode. The sheet resistivity and the length of the suspended line are determined so that the transmission loss substantially increases in the suspended line.

Figure 10B:
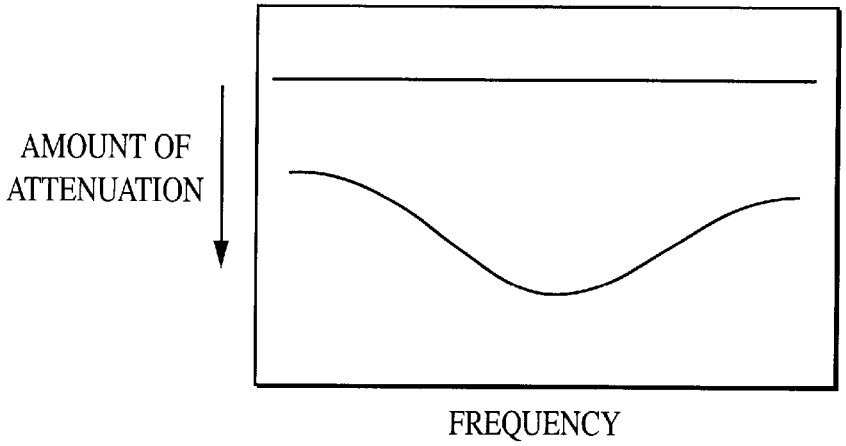
FIG. 10B is a graph showing attenuation-frequency characteristics.

FIG. 10B shows attenuation-frequency characteristics occurring in the dielectric transmission line attenuator. There is no variation of attenuation with respect to frequency occurring in the suspended line. However, there are variations in the coupling strength with respect to frequency between the suspended line and the dielectric transmission line. As shown in this figure, since the amount of attenuation gradually increases in proximity to a predetermined frequency region, the attenuator functions well over a considerably wide frequency bandwidth.

The construction of a wireless communication device according to a sixth embodiment is described with reference to FIG. 11.

Figure 11:
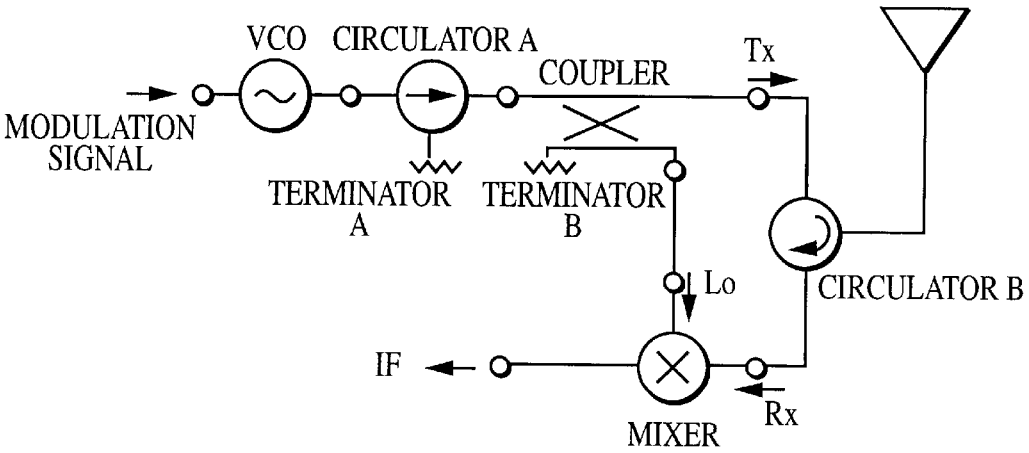
FIG. 11 is a block diagram showing a millimeter-wave radar module according to a sixth embodiment.
Figure 12:
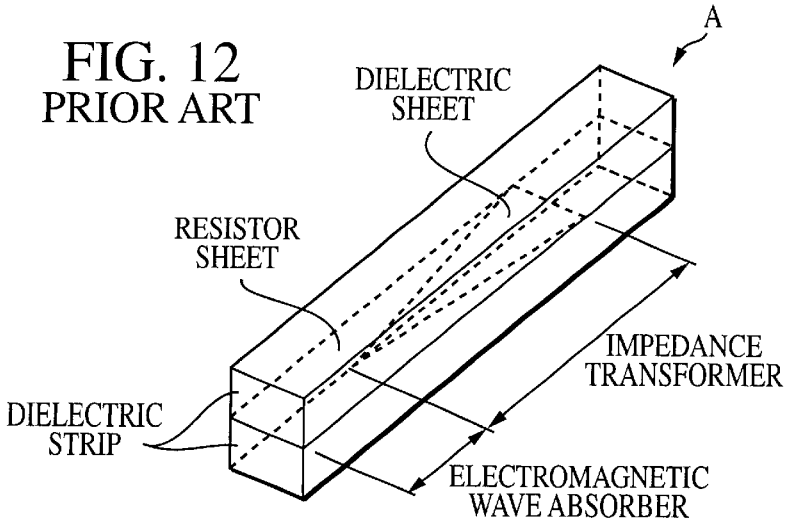
FIG. 12 PRIOR ART
FIG. 12 is a perspective view showing a conventional dielectric transmission line terminator.

FIG. 11 is a block diagram of a millimeter-wave radar module. A voltage-controlled oscillator (VCO) is formed using a Gunn-diode oscillator and a variable reactance element, such as a varactor diode, and generates a millimeter-wave signal in accordance with a modulation signal. A circulator A and a terminator A allow an output signal from the VCO to be transmitted to a coupler and the terminator A absorbs a signal reflected toward the VCO. The circulator A and the terminator A form an isolator. The coupler allows the signal from the circulator A to be transmitted as a transmission signal Tx to a circulator B and extracts a part of the transmission signal Tx as a local signal Lo. A terminator B absorbs a signal reflected from the circulator B to the coupler. The coupler and the terminator B form a directional coupler. The circulator B transmits a transmission signal Tx to an antenna and transmits a received signal Rx from the antenna to a mixer. The mixer mixes the received signal Rx with the local signal Lo to generate a beat signal as an intermediate frequency signal IF.

The dielectric transmission line terminators according to the first to fourth embodiments may be used as the terminator A and the terminator B shown in FIG. 11.

In the first to fourth embodiments, dielectric transmission line terminators are shown as examples. In the manner shown in the fifth embodiment, by providing a substrate 4 having a resistor film pattern 5 formed thereon at a predetermined position (between the input and output ports) between the ends of the dielectric transmission line, the dielectric transmission line attenuator enables electromagnetic waves propagating in the dielectric transmission line between the input and output ports to be attenuated to a predetermined level.

In each embodiment, the dielectric transmission line has grooves for holding the dielectric strips 3 and 3' fitted therein, formed in the upper and lower conductive plates 1 and 2. However, a normal dielectric transmission line in which the distance between the conductive plates in a transmission region is equal to that in a non-transmission region may also be used. Likewise, for example, as disclosed in Japanese Unexamined Patent Application Publication No. 9-64608, a winged dielectric transmission line or an image transmission line may be used.

In each embodiment, the step is formed at a part of one dielectric strip and the substrate is disposed between the step and the other dielectric strip. Alternatively, the dielectric strip can be divided into upper and lower dielectric strip parts along the entire length thereof in the longitudinal direction, and the substrate having the resistor film pattern formed thereon can be provided between the upper and lower dielectric strip parts.

Although the present invention has been described in relation to particular embodiments thereof, many other variations and modifications and other uses will become apparent to those skilled in the art. Therefore, the present invention is not limited by the specific disclosure herein.

What is claimed is:

1. A dielectric transmission line attenuator in a dielectric transmission line provided with two conductive plates substantially parallel to each other, and a dielectric strip held between said two conductive plates, said dielectric transmission line attenuator comprising:

at least one resistor film pattern held at least at a location within said dielectric strip;

said resistor film pattern forming a transmission line with said two conductive plates;

said dielectric transmission line and said transmission line being electromagnetically coupled;

wherein said resistor film pattern has a substantially rectangular shape at said location where the resistor film pattern is held within the dielectric strip; and said dielectric strip and said resistor film pattern crossing substantially perpendicular to each other when viewed from above.

2. A dielectric transmission line attenuator according to claim 1, wherein said transmission line is a TEM mode resonator having two ends, both of which are open.

3. A dielectric transmission line attenuator according to claim 1, wherein said transmission line is TEM mode resonator having two ends, one end being open and the other end being short-circuited.

4. A dielectric transmission line attenuator according to claim 1, wherein said transmission line is a TEM mode resonator having two ends, both ends being short-circuited.

5. A dielectric transmission line attenuator according to claim 1, wherein:

said at least one resistor film pattern comprises a plurality of resistor film patterns, each resistor film pattern being electromagnetically coupled to said dielectric strip at a respective coupling position; and the distance between each two neighboring coupling positions of the resistor film patterns is an odd multiple of a quarter wavelength.

6. A dielectric transmission line attenuator according to claim 5, wherein said resistor film pattern is formed on a substrate, and the substrate has a dielectric constant which is greater than the dielectric constant of said dielectric strip.

7. A wireless communication device comprising:

a dielectric transmission line attenuator according to claim 1; and a high-frequency circuit comprising one of a transmitting circuit and a receiving circuit;

said dielectric strip of said attenuator being connected to said high-frequency circuit.

8. A dielectric transmission line attenuator according to claim 1, wherein said resistor film pattern is formed on a surface extending within said dielectric strip and substantially parallel to said two conductive plates.

9. A dielectric transmission line terminator comprising a dielectric transmission line attenuator according to claim 1, wherein said resistor film pattern is provided in proximity to one end of said dielectric strip.

10. A wireless communication device comprising:

a dielectric transmission line terminator according to claim 9;

a high-frequency circuit comprising one of a transmitting circuit and a receiving circuit;

said dielectric strip of said terminator being connected to said high-frequency circuit.

11. A dielectric transmission line attenuator in a dielectric transmission line provided with two conductive plates substantially parallel to each other, and a dielectric strip held between said two conductive plates, said dielectric transmission line attenuator comprising:

at least one resistor film pattern provided on said dielectric strip, said resistor film pattern forming a transmission line with said two conductive plates;

said dielectric transmission line and said transmission line being electromagnetically coupled; and wherein said resistor film pattern is formed on a substrate, and the substrate has a dielectric constant which is greater than the dielectric constant of said dielectric strip.

12. A dielectric transmission line attenuator according to claim 11, wherein said transmission line is TEM mode resonator having two ends, both of which arc open.

13. A dielectric transmission line attenuator according to claim 11, wherein said transmission line is a TEM mode resonator having two ends, one end being open and the other end being short-circuited.

14. A dielectric transmission line attenuator according to claim 11, wherein said transmission line is a TEM mode resonator having two ends, both ends being short-circuited.

15. A dielectric transmission line comprising:

a first conductive plate;

a second conductive plate, said first and second conductive plates defining a space therein;

a dielectric strip held within said space defined by said first and second conductive plates to form a dielectric waveguide;

a substrate contacting said dielectric strip; and at least one resistor film pattern provided on said dielectric strip and arranged so as to extend substantially perpendicular to a longitudinal direction of said dielectric strip, wherein said at least one resistor film pattern forms a suspended line resonator with said first and second conductive plates, and wherein said at least one resistor film pattern is rectangular in shape.

16. The dielectric transmission line according to claim 15, wherein said at least one resistor film pattern has both ends thereof open circuited.

17. The dielectric transmission line according to claim 15, wherein said at least one resistor film pattern has both ends thereof short circuited.

18. The dielectric transmission line according to claim 15, wherein said at least one resistor film pattern has one end thereof open circuited and another end thereof short circuited.

19. The dielectric transmission line according to claim 15, wherein said at least one resistor film pattern is provided in proximity to one end of said dielectric strip.

20. The dielectric transmission line according to claim 15, wherein said at least one resistor film pattern comprises a plurality of resistor film patterns, each resistor film pattern of the plurality of resistor film patterns individually forming a suspended line resonator with said first and second conductive plates.

* * * * *